United States Patent [19]

Palazzo

[11] Patent Number: 4,780,947

[45] Date of Patent: Nov. 1, 1988

[54] METHOD OF MAKING DOUBLE WALL STORAGE TANK WITH CHANNELED SPACER MEANS

[76] Inventor: David T. Palazzo, P.O. Box 290676, Tampa, Fla. 33687

[21] Appl. No.: 105,890

[22] Filed: Oct. 7, 1987

Related U.S. Application Data

[60] Continuation-in-part of Ser. No. 43,634, Apr. 28, 1987, Pat. No. 4,744,137, which is a division of Ser. No. 884,481, Jul. 11, 1986, abandoned, which is a continuation-in-part of Ser. No. 775,140, Sep. 12, 1985, Pat. No. 4,640,439, which is a continuation-in-part of Ser. No. 818,258, Jan. 13, 1986, Pat. No. 4,674,627.

[51] Int. Cl.[4] ..... B23P 9/00

[52] U.S. Cl. ..... 29/455.1; 29/458; 138/149; 215/12.2; 220/445; 264/251

[58] Field of Search ..... 29/455 R, 458, 445; 220/445, 420.1 B, 448, 466, 469, 465, 226, 855; 215/12.2; 138/148, 149; 264/251, 318

[56] References Cited

U.S. PATENT DOCUMENTS

| | | | |
|---|---|---|---|
| 761,548 | 3/1904 | Sheaff | 220/445 |
| 2,551,710 | 5/1951 | Slaughter | 29/455 R UX |
| 3,746,595 | 7/1973 | Leason | 264/251 X |
| 3,848,765 | 11/1984 | Durkop | 220/445 |
| 3,921,273 | 11/1975 | Kondo et al. | 29/455 R X |
| 3,987,925 | 10/1976 | Sattelberg | 220/445 X |
| 4,400,863 | 8/1983 | Schroeder | 29/458 X |
| 4,523,454 | 6/1985 | Sharp | 220/449 |
| 4,524,609 | 6/1985 | Sharp | 73/49.2 |
| 4,537,328 | 8/1985 | Keesee et al. | 220/445 |
| 4,651,893 | 3/1987 | Mooney | 220/445 |

FOREIGN PATENT DOCUMENTS

| | | | |
|---|---|---|---|
| 197808 | 8/1978 | Switzerland | 220/445 |

*Primary Examiner*—Charlie T. Moon

*Attorney, Agent, or Firm*—Pettis & McDonald

[57] ABSTRACT

A double wall tank for the storage of liquids is manufactured from a rigid single wall inner tank by applying to at least a portion of the exterior surface of the inner tank a hardenable synthetic resin spacer material and forming in the spacer material one or more channels that provide for substantially free passage of liquids through the channels. A substantially imperforate film is stretched across the spacer material and over the one or more channels to separate the inner tank and the spacer material from subsequently applied sheathing material. A substantially rigid outer sheathing material that is substantially liquid-tight is applied over the inner tank exterior and the spacer material and the film overlying the spacer material such that the sheath is spaced from at least a portion of the inner tank exterior surface so as to provide a rigid double wall tank.

22 Claims, 4 Drawing Sheets

METHOD OF MAKING DOUBLE WALL STORAGE TANK WITH CHANNELED SPACER MEANS

RELATED APPLICATION

This application is a continuation-in-part of application Ser. No. 043,634 filed Apr. 28, 1987, now U.S. Pat. No. 4,744,137, which application is a division of application Ser. No. 884,481, filed July 11, 1986, now abandoned, which application is a continuation-in-part of application Ser. No. 775,140 filed Sept. 12, 1985, and issued as U.S. Pat. No. 4,640,439 and of application Ser. No. 818,258 filed Jan. 13, 1986, issued as U.S. Pat. No. 4,674,627, both entitled Double Wall Storage Tank and Method of Making Same and filed in the name of David T. Palazzo.

FIELD OF THE INVENTION

This invention relates to a double wall tank for the storage, and in particular for the underground storage, of liquids and to an improved method for making such a double wall storage tank.

BACKGROUND OF THE INVENTION

Tanks for the storage of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tnaks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has promoted the search for methods of fabricating relatively inexpensive double wall tanks. This burden has also given impetus to the search for a method of remanufacturing existing single wall tanks into a double wall assembly with means for detecting the presence of any leaks into the space between the two walls.

A number of techniques have been disclosed for converting single wall tank into double wall tank and providing such tanks with the means for detecting the presence of leaks. Such methods are shown for example in my U.S. Pat. No. 4,640,439 as well as my copending application Ser. No. 046,634. Although these techniques provide for quite acceptable double wall tanks they do require the employment of a perforated spacing material such as mesh, or alternatively, a molded spacing material that must be constructed and applied to the inner tank. The labor and time involved in constructing and installing these spacing materials can be significant and the need certainly exists to reduce even further the cost of producing such double wall tanks.

SUMMARY OF THE INVENTION

In view of the foregoing it is the object of the present invention to provide an improved economical method of manufacturing a double wall storage tank from a single wall tank.

It is a further object of this invention to provide such a method in which at least a portion of the outer wall or sheath of the tank is spaced from the outer inner tank.

It is a further object of this invention to provide a method of constructing a double wall storage tank that does not require the construction or installation of intricate or expensive spacing materials and instead employs efficient and relatively inexpensive spacer construction techniques.

To achieve these and other objects that will become readily apparent to those skilled in the art, this invention provides a method of manufacturing from a rigid single wall inner tank a double wall tank for the storage of liquids. This method includes the steps of applying to at least a portion of the exterior surface of the rigid inner tank a hardenable synthetic resin spacer material and forming in the applied synthetic resin spacer material channel means that provides for substantially free passage of liquids through the channel means. A substantially imperforate film is stretched over the spacer material and over the channel means to separate the inner tank and the spacer material from subsequently applied sheath material. A substantially rigid outer sheath of material that is substantially liqud-tight is applied over the inner tank exterior and the spacer material and the film overlying the spacer material. The sheath is spaced from at least a portion of the inner tank exterior surface by the film and the spacer material such that a rigid double wall tank is provided.

In a preferred embodiment the synthetic resin spacer material may be applied in gelations form or in the form of a self-expanding foaming agent. A polyester foam or similar substance is especially preferred, and foamed silica may be employed so that excessive fluidity of the resin is prevented. Foam permits a desirable thickness of spacer material to be achieved while reducing the amount of such material required. The spacer material may alternatively comprise an epoxy or various other syntheic resins. Typically, the channel means are formed in the synthetic resin before it hardens, and the imperforate film is stretched across the spacer material after it has hardened. The imperforate film may include a synthetic resin such as Mylar, polyethylene or other similarly thin material.

A plurality of alternating channel and ridges may be formed in the spacer material and the imperforate film may engage such ridges. The channel means may be formed by engaging channel forming means with the spacer material and moving the inner tank and the channel forming means relative to one another to drive the channel forming means through the spacer material. Typically, the channel means may be formed by diverting spacer material from the channels to the ridges whereby the ridges are reinforced by the spacer material. Such channel forming means may accordingly be configured to divert the spacer material into the ridges as the channel forming means are driven through the spacer material. The channel forming means may include one or more teeth of a notched trowel device. In another preferred embodiment the channel forming means comprise flexible fingers of, for example, a rake device. Such fingers compensate for tanks that are uneven or out of round and adjust for the surface contour of the inner tank such that they form relatively uniform even channels. Alternatively, the channel forming means may include annular blade means formed circumferentially about a drum that may be axially rotatable. The invention may further comprise the step of disposing cleaning means adjacent the blade means to remove spacer material that has collected on the blade means. In still another embodiment the channel means may be formed by impressing the spacer material on the inner tank in a desired pattern. Various alternative channel forming techniques may also be employed.

Preferably, the inner tank has a generally cylindrical configuration with closed ends and the channel means are formed substantially circumferentially about the inner tank. A plurality of circumferential rows of radially outwardly facing projections may be formed in the spacer material applied to such a cylindrical inner tank and the channel means may be formed substantially circumferentially about the inner tank between the rows of projections.

The method of this invention may further comprise the step of forming passageway means that interconnect adjacent channels of the channel means. Such passageway means are typically formed by scoring the resin between adjacent channels. This scoring may be performed proximate the bottom of the cylindrical inner tank as well as along other generally longitudinal axes about the circumference of the inner tank. In the embodiment that features multiple rows of outward projections, the passageways are typically formed between the adjacent projections in each row.

The outer sheath may be formed by a resin impregnated glass fiber material that is supported by the synthetic resin spacer material and the stretched imperforate film away from the inner tank.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENT

Figure 1:
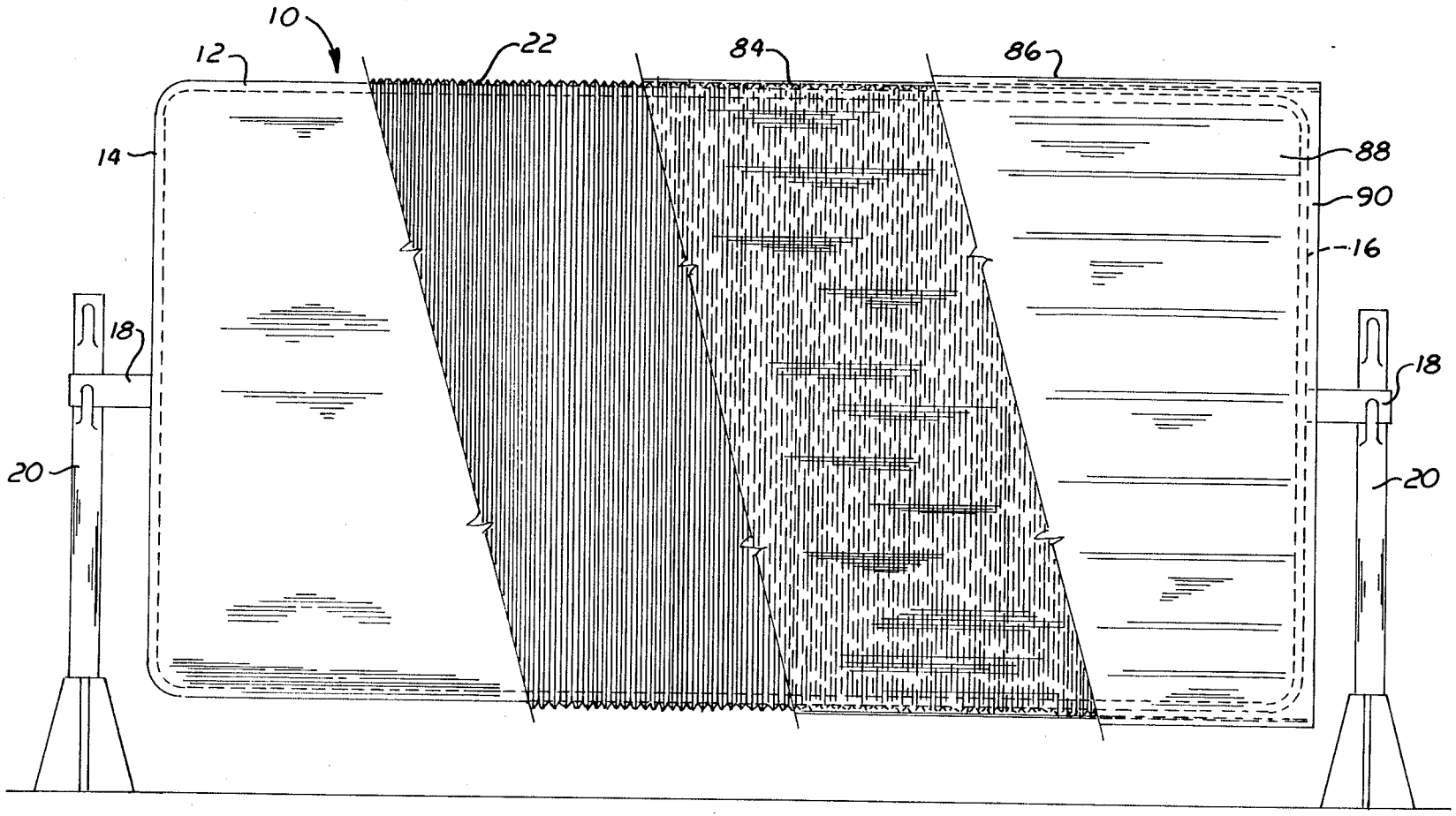
FIG. 1 is a side elevational view, partially in section, of a tank according to the present invention illustrating various steps in the fabrication process.

A preferred embodiment of the double wall tank 10 manufactured according to the method of this invention is illustrated in FIG. 1. The completed tank assembly is accomplished by applying the various materials, as hereinafter described, to an inner storage tank 12.

While various forms and shapes of tanks may be utilized in practicing this invention, the most common shape for underground storage is that of a cylinder, generally a right circular cylinder having closed end portions 14 and 16. For simplicity of illustration this configuration of the tank is utilized for illustrating the preferred embodiment of the invention. Also, while virtually any construction of a rigid inner tank, whether metal or fiberglass or other materials, may be utilized in practicing this invention, one preferred and readily available type of structure is a tank formed of welded steel, having an appropriate corrosion resistant coating on the liquid contact surfaces. For purposes of illustration such a sealed tank will be described. It also is to be understood that the tank to be used could be a newly fabricated tank, which may or may not have any manhole opening cut in it, or it may be previously used tank removed from its prior underground installation and cleaned for reuse with this invention.

To prepare an uncoated or previously used steel tank, it is desirable that the exterior surface be conventionally sandblasted and coated with a rust inhibitive paint. Then, to simplify subsequent steps, it is preferred but not required that a spindle 18 be attached, such as by welding, to the center of each tank head or end portion 14, 16 collinear with the axis of tank 12. As shown in FIG. 1 these spindles 18 and thus the inner tank 12 may then be supported off the ground on conventional uprights 20. This provides for rotation of the tank about its axis for purposes to be set forth below.

Figure 2A:
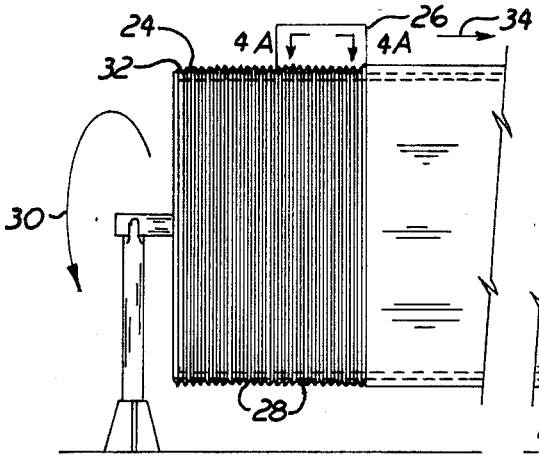
FIG. 2A is a fragmentary side elevational view of a rotatably mounted inner tank and a preferred notched trowel device for forming channels in synthetic resin spacer material disposed about the tank.
Figure 2B:
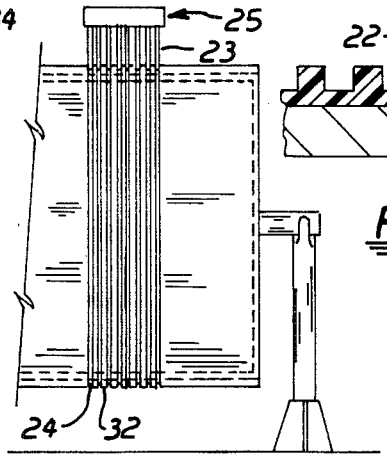
FIG. 2B is a fragmentary side elevational view of an inner tank and an alternative preferred rake device for forming the channel means in the spacer material.

In the next step of the present invention a spacer material 22 is applied to at least a portion, preferably the lower portion, of the exterior surface of inner tank 12 and may be applied as shown in FIGS. 1, 2A and 2B to the entire exterior side surface of tank 12. Spacer material 22 may comprise any of a variety of types of synthetic resin. Preferably, the resin is applied in the form of a known polyester resin having a self expanding foaming agent. A desired foamable resin material having a normal thickness of, for example, 0.020 inches expands to approximately 0.040 inches. Because foam is employed, less resin material is required to provide the required thickness of spacer material 22. Alternatively, spacer material 22 may be applied in gelatinous form and may include epoxy or a similar substance.

As shown most clearly in FIGS. 2A and 2B, channel means that comprise a plurality of circumferential channels 24 are formed in material 22. Channels 24 provide for the free flow of fluid longitudinally therethrough. In one preferred embodiment channels 24 are formed by a notched trowel device 26 having channel forming means such as teeth 28 in at least one edge thereof. Teeth 28 engage spacer material 22, and inner tank 12 is rotated in the direction of arrow 30 so that teeth 28 are driven relatively through material 22. This forms a plurality of alternating circumferential channels 24 and ridges 32 in spacer material 22. After the inner tank 12 has been completely axially rotated so that channels 24 and ridges 32 are formed by trowel device 26 about the entire circumference of tank 12 the trowel device is moved axially along tank 12 in the direction of arrow 34 so that similar circumferential channels 24 may be formed in the remainder of the exterior side surface of the tank 12. Of course, in an alternative embodiment the tank may remain stationary and trowel device 26 may be moved through the resin either mechanically or by hand to form the channels 24 and ridges 32 about inner tank 12.

Figure 4B:
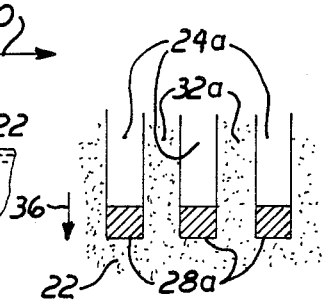
FIG. 4B is an enlarged sectional view of alternative teeth having a quadrilateral cross section.
Figure 4A:
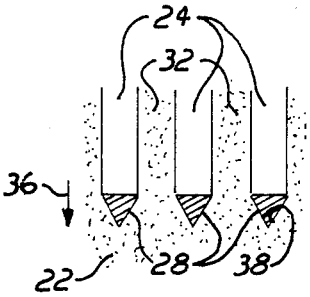
FIG. 4A is an enlarged sectional view of preferred pointed trowel teeth taken along line 4A—4A of FIG. 2A.

There is shown in FIG. 4A a significantly enlarged cross sectional view of several preferred teeth 28 that may be employed in the trowel device. Such teeth have a generally triangular cross sectional configuration with a pointed leading edge. As a result, as teeth 28 engage spacer material 22 and are driven relatively through the spacer material in the direction of arrow 36, they move in a wedge-like manner and plow through spacer material 22. This creates channels 24 that trail behind teeth 28. At the same time spacer material 22 is diverted by the inclined surfaces 38 of teeth 28 onto ridges 32. As a result, the wedge-like shape of teeth 28 tends to reinforce ridges 32 and thereby produces an improved spacer material.

Alternative channel forming teeth **28*a* having a quadrilateral cross-sectional shape are shown in FIG. 4B. Teeth 28*a* engage resin 22 and, as the tank 12 is rotated as described above, teeth 28*a* move relatively through the resin in the direction of arrow 36. As a result, channels 24*a* are formed behind teeth 28*a* and ridges 32*a* are formed between channels 24. Although this technique is typically acceptable it does not provide for the reinforced ridges that are achieved by employing the teeth shown in FIG. 4A and may necessitate periodic cleaning of resin from teeth 28*a*** and the resultant waste of that resin.

Figure 3:
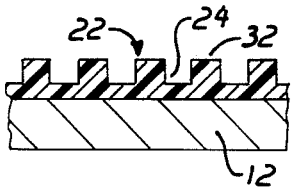
FIG. 3 is an enlarged sectional view of the spacer material disposed on the inner tank with the circumferential channels and ridges formed therein.

Alternatively, as shown in FIG. 2B, channels 24 and ridges 32 may be formed by the flexible fingers 23 of a rake device 25. The distal tips of fingers 23 engage spacer material 22 and as tank 12 rotates fingers 23 move relatively through the synthetic resin to form the alternating arrangement of channels and ridges. Because fingers 23 are flexible they compensate for uneven or asymmetrical area on the surface of tank 12 and provide relatively even uniform channels 24. Rake device 25 may also be moved along tank 12 in a manner similar to device 26 to form channels about the entire exterior side surface of tank 12. An enlarged cross-sectional view of the channels 24 and ridges 32 formed in resin spacer material 22 is shown in FIG. 3. Although such channels are shown in greatly enlarged form, in actuality they may be quite shallow. For example each channel may suitably be approximately 0.030 to 0.070 inches deep. Moreover the width of each channel and each ridge may typically be approximately 0.070 to 0.1 inches. Of course, such dimensions are provided for illustrative purposes only and are not meant to limit the possible dimensions that may be exhibited by this invention. For example, the channels may be considerably larger, particularly when formed by flexible fingers 23 of rake device 25. The only limitation on the size of channels 24 is that they should not be so wide that the imperforate film described below will sag into the channels sufficiently to block the free flow of fluid therethrough.

Figure 11:
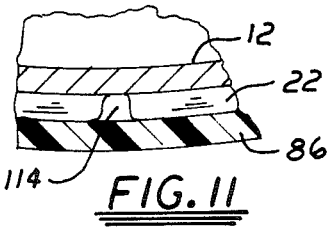
FIG. 11 is an enlarged sectional view of the lower portion of the completed tank of FIG. 1 showing the passageway that interconnects the channel means.

As shown in FIG. 11 a passageway 114 is preferably provided through the adjacent ridges 32 to interconnect the adjacent channels 24. This passageway 114 is preferably formed through spacer material 22 along the bottom of inner tank 12, although additional passageways may be formed longitudinally through the spacer material at other points about the circumference of tank 12. Passageway 114 is typically formed by scoring the spacer material either in its pre-hardened form or hardened form. The passageway 114 enables fluid which has leaked into the passageways channels to be detected in the manner described below.

Figure 5:
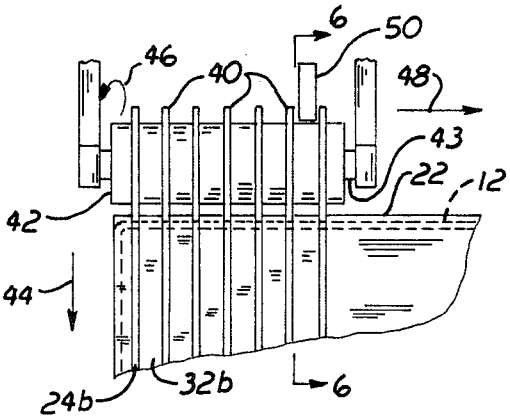
FIG. 5 is a partial elevational view of a drum device having circumferential blades for forming the channel means in the inner tank.
Figure 6:
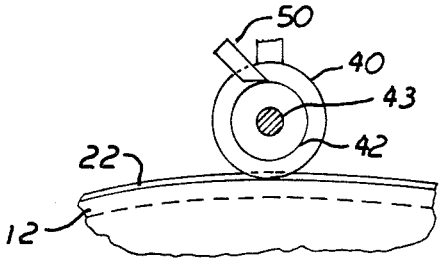
FIG. 6 is a sectional view of the channel forming device of FIG. 5 with a scraper device for cleaning synthetic resin that collects between the blades.

An alternative technique for forming circumferential channels in tank 12 is shown in FIG. 5. Therein the channel forming means comprise annular blades 40 that are circumferentially mounted on a drum 42 that is rotatable about an axis defined by shaft 43. As shown in FIGS. 5 and 6, blades 40 engage synthetic resin spacer material 22 and inner tank 12 is rotated for example in the direction of arrow 44. Drum 42 is rotated in the direction of arrow 46 by the rotating inner tank 12. This causes the blades 40 to move through spacer material 22 so that alternating channels **24*b* and ridges 32*b* are formed about the circumference of inner tank 12. These channels and ridges appear similar to those shown in FIG. 3 and, in particular, channels 24*b* enable fluid to flow freely therethrough. As previously indicated, such circumferential channels may be formed in the entire exterior side surface of inner tank 12 by moving drum 42 relative to tank 12, for example in the direction of arrow 48 shown in FIG. 5. As this channel forming process is continued the synthetic resin spacer material may tend to collect between blades 40. To remove this material means such as a scraper or other cleaning apparatus 50, shown in FIG. 6, is disposed between blades 40. As a result, while drum 42 rotates scraper apparatus 50** scrapes away spacer material that is collected between the blades.

Figure 7:
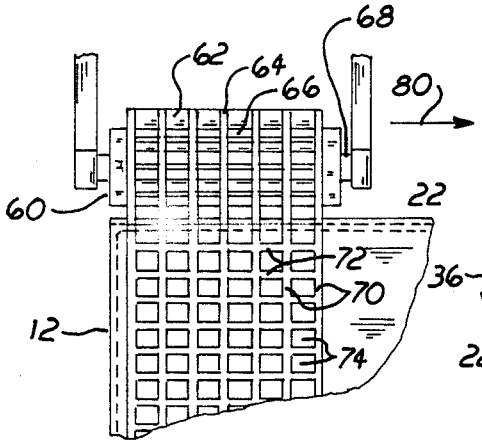
FIG. 7 is a elevational view of further alternative device for forming channels in the inner tank.

A further alternative technique for forming circumferential channels in inner tank 12 is shown in FIG. 7. Therein an axially rotatable drum 60 is provided with a circumferential surface 62 having a waffled pattern formed therein. In particular, surface 62 comprises a plurality of annular circumferential elements 64 having rows of axially aligned elements 66 formed between them. Waffled surface 62 engages the spacer material 22 on the exterior surface of tank 12 and, as tank 12 is rotated, the drum 60 correspondingly rotates on the shaft 68 so that circumferential and axial elements 64 and 66 form a similar pattern of circumferential channels 70 and axially aligned passageways 72 in spacer material 22. In particular, waffled surface 62 impresses the spacer material 22 on the exterior surface of tank 12 to form a waffle-like pattern of channels and passageways. This form circumferential rows of projections 74 in spacer material 22. Circumferential channels 70 are located between each row of projections 74. The channels are of sufficient size to conduct fluids therethrough and the axially aligned passageways permit free flow of fluid between adjacent circumferential channels 70. Again, after each successive circumferential portion of tank 12 is impressed, the entire exterior surface of inner tank 12 may be provided with a similar pattern of channels by repositioning drum 60 with waffled surface 62 longitudinally along tank 12 in the direction of arrow 80.

As shown in FIG. 1, a web of substantially imperforate material, such as a stretched film 84 of synthetic resin is stretched over spacer material 22 as tank 12 is rotated on its spindles 18. This film is preferably composed of a thin flexible material such as Mylar, polyethylene or the like. Film 84 is typically applied over spacer material 22 when the spacer material is in a hardened condition. If the spacer material 22 is applied to tank 12 as expandable foam, or as epoxy or other gelatinous substance, film 84 is applied after that spacer material has hardened. When film 84 is applied, it engages ridges 32 and is stretched over channels 24. A sheathing material 86 is then applied over film 84 in a manner as described below. This application of stretched film 84 over spacer material 22 prevents subsequent material used in forming the outer sheath 86 from contacting those portions of inner tank 12 over which spacer material is applied.

In this preferred embodiment the rigid outer sheath 86 preferably, and particularly the cylindrical side wall portions 88 thereof, are formed by applying resin impregnated glass fiber mats to film 84 in a conventional manner or by use of a chopper gun. It has been found convenient to lay sections of such glass fiber matting over the film wrapped inner tank and then apply suitably and well-known resins to that matting, although matting that is not preimpregnated with resin could be used with equal facility. While the thickness of the outer sheath 86 may vary according to the severity of conditions anticipated, it should be of sufficient thickness to provide a substantial rigid sheath. It has been found that one-quarter inch thickness of the cured, resin impregnated glass fiber generally provides sufficient strength and rigidity for the sheath. The end portions 90 of outer sheath 86 may be formed by the various techniques shown in my co-pending U.S. patent application Ser. No. 043,634 and are incorporated herein by reference.

The remaining steps involved in the manufacture of the double wall tank of this invention may depend upon the nature of the inner tank 12 used to manufacture the product. If tank 12 is a previously used unit, or one that already incorporates a manhole or other aperture for access to the interior, such as element 98 shown in FIGS. 8 and 10 and, may also include other plumbing connections, the application of the exterior sheath 86 is preferably done in the manner that bonds around those fittings and apertures, while providing for access to them. With this situation little additional work may be necessary to complete the manufacture of the product of this invention.

Figure 9B:
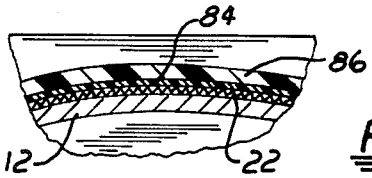
FIG. 9B is a fragmentary enlarged view of the edge of the aperture shown in FIG. 9A.
Figure 9A:
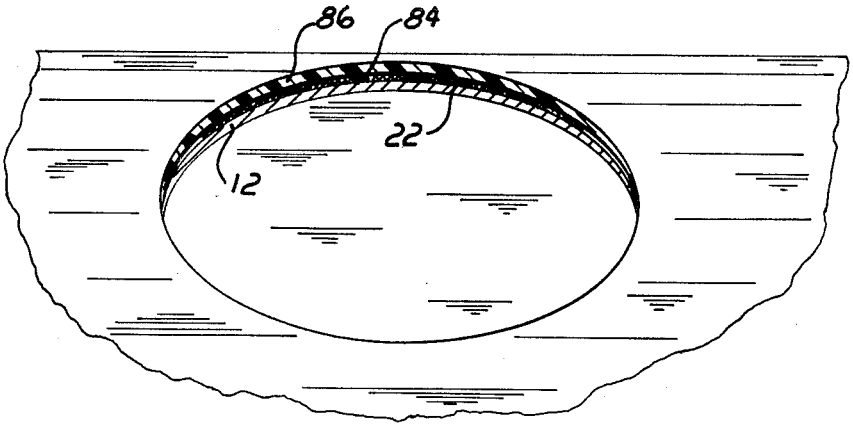
FIG. 9A is an upper perspective view of the tank of FIG. 1 illustrating the cutting of an aperture through the tank wall and outer sheath.

If the inner tank 12 from which the article is manufactured is a new tank, or a remanufactured one in which there exists no apertures or fittings, it is easiest to apply the sheath 86 around the cylindrical side walls in a continuous manner. Then to form the necessary opening into the interior of the tank, appropriate holes may be cut by any suitable means, such as a hole saw or the like. In most tanks it is desirable to provide access to the interior that is large enough for entry of a person into the tank. This may be done by forming an aperture, as by cutting, through the outer sheath 86, the spacer material 22, the film 84 and a portion of the cylindrical sidewall of the inner tank 12, as shown in FIGS. 9A and 9B. Then, preferably from the inside of the tank, a hollow cylindrical member 98, preferably having a shape and size corresponding generally to the shape and size of the aperture cut, is sealingly joined to cylindrical side wall of the tank 12, suitably by welding the joint adjacent the periphery of the aperture to the inner tank 12. This then provides the necessary manhole. Additional holes may be cut through the sheath 86 and inner tank 12 for insertion and attachment, suitably by welding, of additional fittings such as for introduction and withdrawal of liquid from the tank. When all of these fittings have been affixed to the tank, the portions of the sheath 86 adjacent those various fittings may then be bonded thereto with appropriate resin, to yield a finished structure as shown in the fragmentary perspective view of FIG. 10.

A suitable cover plate 100 may be provided for the cylindrical member 98 as shown in FIG. 8A. This cover plate may conventionally be secured to the upper flange 102 of that cylinder member 98 by conventional means such as a plurality of bolts 104 extending through the cover plate 100 and the flange 102. In this cover plate may be provided such items as a lifting ring 106 and conventional fittings 108 and 110 to provide for insertion of appropriate plumbing to facilitate introduction and withdrawal of liquids to be stored within the completed tank.

Figure 10:
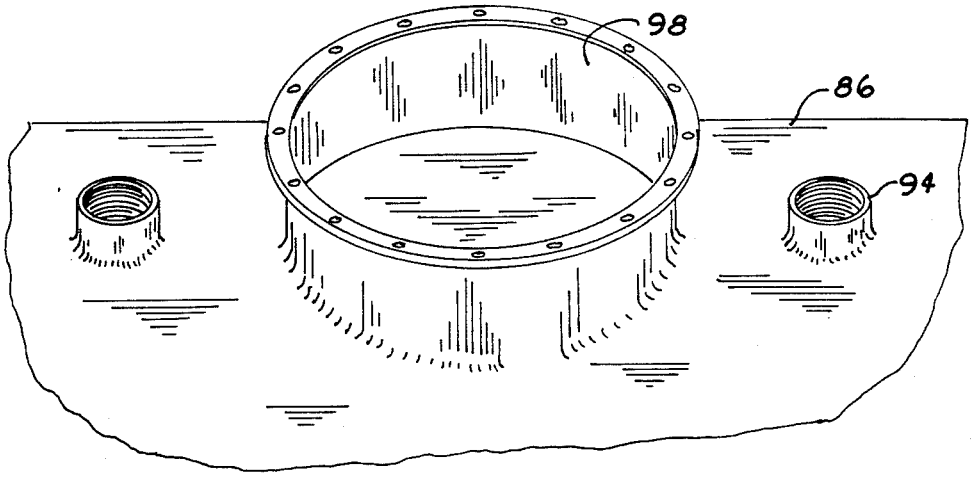
FIG. 10 is a perspective view of the apparatus of FIG. 9A illustrating the completed installation of a port and of plumbing connections.
Figure 8:
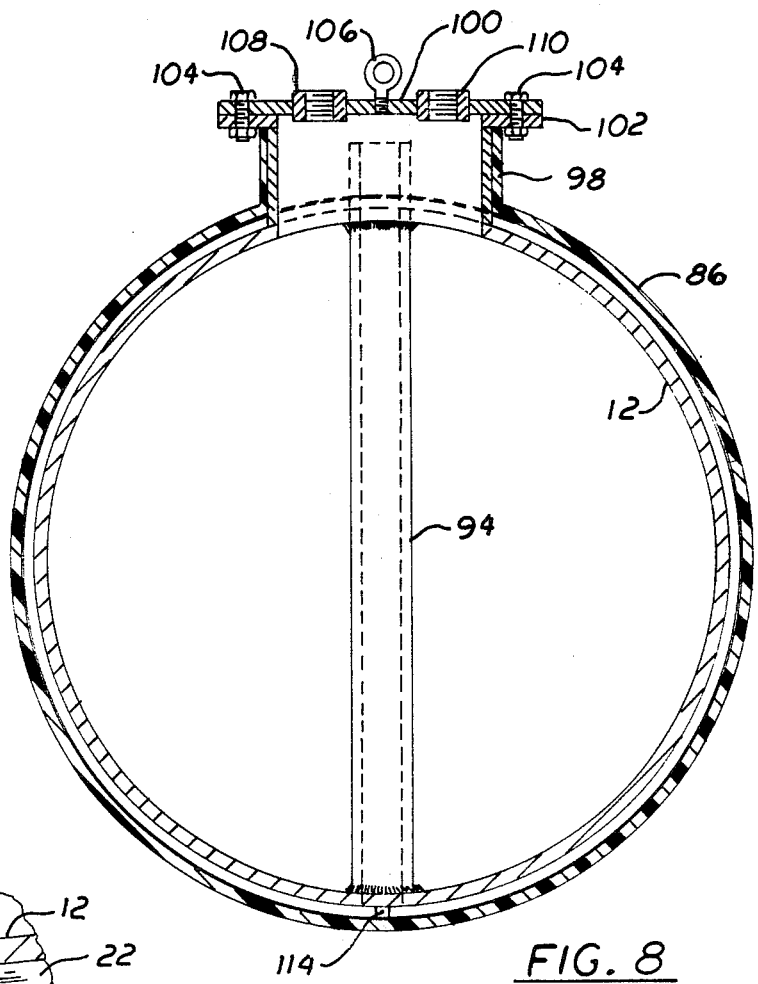
FIG. 8 is an end-sectional view of the completed tank formed according to the method shown in FIG. 1.

A tube 94 for use in detecting the presence of liquid in the space between the inner tank 12 and sheath 86 is illustrated in FIG. 8. The tube 94 extends through the tank 12. This tube 94 may be installed by providing an aperture through the cylindrical sidewall of the outer sheath 86, as shown in FIG. 10, through the adjacent upper portion of the inner tank and then through the diametrically opposed lowermost portion of the inner tank 12. Thus, the tube may be inserted through the outer sheath aperture and extend through the tank and through the aperture in the lowermost portion thereof so that the lower portion of tube 94 is adjacent the lower portion of the space between the inner tank 12 and sheath 86. The joints between the tube 94 and the outer sheath 86 of the inner tank 12 are sealed liquid-tight in conventional manners. Tube 94 provides the means within the space between the inner tank exterior surface and the outer sheath inner surface for detecting the presence of liquids within that space and for withdrawing such liquid, if desired. Specifically, fluid that has leaked into the channels through either the interior of the tank 12 or from the exterior of outer sheath 86 passes along the bottom of the tank through passageway 114 so that it can be detected by tube 94. Alternative means techniques for constructing the detraction tube are shown in U.S. patent application Ser. No. 884,481.

On completion of the manufacturing steps set forth above, both the inner tank 12 and its sheath 86 may have pressure applied to them, as by compressed air. With the apparatus illustrated as in FIG. 8 the application of pressure through the tube 94 will not only permit the testing of the sheath 88 for any leakage but also will permit testing of the tank 12 to ascertain if there is any leakage of that pressurized air from the space between the sheath 86 and the inner tank 12 into that inner tank 12.

By the foregoing construction there is thus provided a double wall tank that can be manufactured economically from a conventional steel wall tank and even from a used tank that has previously been removed from underground storage use. This structure provides an exterior sheath, which may be formed from a material that is free of any tendency to rust or corrode, and which is spaced from the inner tank to permit the collection within that space and thus detection of any liquids leaking into that space, either from the tank or from sources exterior to the sheath. Thus may be determined the existence of any leakage of either the tank or the sheath by simply detecting the presence and nature of any liquid present in that space. By the use of a relatively thick and rigid outer sheath, the strength of that sheath is enhanced over similar structures that may use flexible outer covering. Furthermore, such a rigid external sheath permits testing of the integrity of the sheath and tank at substantial pressures, which could not be done with a flexible covering without danger of rupture.

While the foregoing describes in detail several preferred embodiments of the tank of this invention, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited soley by the claims appended hereto.

What is claimed is:

1. A method of manufacturing from a rigid single wall inner tank for storage of liquids, a double wall tank, said method comprising the steps of:

applying to at least a portion of the exterior surface of said rigid inner tank a hardenable synthetic resin spacer material forming in said spacer material channel means that provides for substantially free passage of liquids through said channel means;

stretching a substantially imperforate film over said synthetic resin spacer material and over said channel means to separate said inner tank and said spacer material from subsequently applied sheath material; and applying over said film overlying said spacer material a substantially rigid outer sheath of a material that is substantially liquid-tight, said sheath being spaced from at least a portion of said inner tank exterior surface by said film and said spacer material, whereby is provided a rigid double wall tank.

2. The method of claim 1 in which said synthetic resin spacer material is applied in gelatinous form.

3. The method of claim 1 wherein said synthetic resin spacer material includes a self-expanding foaming agent.

4. The method of claim 1 wherein said channel means are formed in said synthetic resin spacer material before said resin has hardened and wherein said imperforate film is stretched across said spacer material after said resin has hardened.

5. The method of claim 1 wherein said channel means comprises a plurality of alternating channels and ridges in said spacer material.

6. The method of claim 5 further including the step of forming passageway means for interconnecting adjacent said channels of said channel means.

7. The method of claim 6 in which said passageway means are formed by scoring said spacer material between said adjacent channels.

8. The method of claim 5 wherein said step of forming channel means comprises engaging channel forming means with said spacer material and moving said inner tank and said channel forming means relative to one another to drive said channel forming means through said spacer material.

9. The method of claim 8 wherein said channel forming means comprise one or more teeth of a notched trowel device.

10. The method of claim 8 wherein each said channel forming means comprise one or more flexible finger elements.

11. The method of claim 8 wherein said step of forming channel means comprises diverting said spacer material from said channels onto said ridges to reinforce said ridges with said spacer material.

12. The method of claim 11 wherein said channel forming means are configured to divert spacer material from said channels into said ridges as said channel means are driven through said spacer material.

13. The method of claim 8 wherein said channel forming means comprise annular blade means extending circumferentially about axially rotatable drum means.

14. The method of claim 13 further comprising disposing cleaning means adjacent said blade means to remove said spacer material collecting on said blade means.

15. The method of claim 1 wherein said channel means are formed by impressing said spacer material with a channel forming means before said spacer material hardens.

16. The method of claim 15 wherein said step of forming channel means further comprises forming a plurality of circumferential rows of radially outward projections in said spacer material such that said channel means are formed between rows of said projections.

17. The method of claim 1 wherein said inner tank has the configuration generally of a cylinder with a cylindrical axis and closed ends and wherein said spacer material is applied to the cylindrical wall portions thereof, whereby said spacer material will serve to space the outer sheath radially from the outer surface of the cylindrical wall of the inner tank, with the sheath being of a generally cylindrical form with cylindrical wall portions and closed end portions and said step of forming said channel means includes the step of engaging channel forming means with said spacer material and axially rotating said inner tank and said channel forming means relative to one another to move said channel forming means through said spacer material.

18. The method of claim 1 further comprising the step of forming an aperture through said sheath, said spacer material and through a portion of a wall of said inner tank, whereby is provided access to the interior of said inner tank.

19. The method of claim 18 further comprising the steps of sealingly joining to said wall of said inner tank adjacent the periphery of said aperture therethrough a hollow cylindrical member having a cylindrical shape and size corresponding generally to shape and size of said inner tank aperture and sealingly joining said outer sheath to said hollow cylindrical member.

20. The method of claim 1 further comprising the steps of forming of an aperture through said outer sheath and the insertion of tube means through said aperture and extending between the inner surface of said outer sheath and said inner tank exterior surface to a point adjacent a lower portion of said outer sheath inner surface, and the forming of a liquid-tight joint beteen the exterior surface of said tube member and said outer sheath, whereby any liquid within the space between the inner tank and the outer sheath may be contacted by and withdrawn through the tube means.

21. The method of claim 1 in which said sheath comprises at least one layer of fibrous material coated with a curable resin which, upon curing, provides a coating that is resistant to passage of water or hydrocarbon liquids.

22. The method of claim 21 in which said fibrous material comprises a mat of glass fibers.

* * * * *